US005572807A

United States Patent [19]

Kelly et al.

[11] Patent Number: 5,572,807

[45] Date of Patent: Nov. 12, 1996

[54] COMPOSITE, WEAR-RESISTANT STUD FOR SPORT SHOES

[75] Inventors: Paul A. Kelly, Atherstone; William H. Parry, Groby, both of Great Britain

[73] Assignee: Trisport Limited, Tamworth, England

[21] Appl. No.: 563,869

[22] Filed: Nov. 29, 1995

Related U.S. Application Data

[63] Continuation of Ser. No. 360,719, filed as PCT/GB93/01142, May 28, 1993, abandoned.

[30] Foreign Application Priority Data

Jun. 10, 1992 [GB] United Kingdom ..... 9212274
Dec. 23, 1992 [WO] WIPO ..... PCT/GB92/02391

[51] Int. Cl.[6] ..... A43B 5/00

[52] U.S. Cl. ..... 36/127; 36/134; 36/67 R

[58] Field of Search ..... 36/127, 134, 59 R, 36/67 R, 67 A, 67 B, 67 D

[56] References Cited

U.S. PATENT DOCUMENTS 3,552,043 1/1971 Moffa ..... 36/67
3,828,364 8/1974 Aoyama ..... 36/67 B
4,063,372 12/1977 MacNeill ..... 36/127
4,193,216 3/1980 Ueda ..... 36/67 D
4,783,913 11/1988 Aoyama ..... 36/134

FOREIGN PATENT DOCUMENTS 0740447 1/1933 France ..... 36/67 D
0780758 8/1957 United Kingdom ..... 36/67 D
1277684 6/1972 United Kingdom ..... 36/67 D
2028102 3/1980 United Kingdom .
2248762 4/1992 United Kingdom .

*Primary Examiner*—Ted Kavanaugh
*Attorney, Agent, or Firm*—Schweitzer Cornman & Gross

[57] ABSTRACT

A golf shoe stud comprises a molded plastics body enabling the stud to be mounted in the underside of the shoe, a steel stem which extends through the body and forms a frusto-conical stump projecting below the body, a thin steel lamina which overlies the underside and edges of the plastics body, and a nose of tungsten carbide which is mounted on the stump. The nose is bonded to the stump by brazing, and an upper end portion of the steel stem is out-turned for securement of the body and the lamina between the out-turned portion and the nose. The stud may be of a replaceable kind in which the plastics body forms a threaded spigot and a sole-engaging flange, or it may be of a permanent kind in which the molded body is arranged to be incorporated in manufacture into a molded shoe sole.

14 Claims, 1 Drawing Sheet

COMPOSITE, WEAR-RESISTANT STUD FOR SPORT SHOES

This application is a continuation of our prior application Ser. No. 08/360,719, filed as PCT/GB92/01142 May 28, 1993, now abandoned.

This invention relates to the provision of studs in the undersides of shoes, boots and other articles of footwear for use in games, sports and other athletic activities to reduce or eliminate slipping on the ground.

One well known example of such a stud is described in GB-A-2 028 102. The stud there described comprises a hardened steel pin secured within a moulded plastics body for securement in a shoe sole (or heel). The pin comprises an enlarged head forming a ground-engaging nose of the stud which projects from a broad sole-engaging flange of the body. The head abuts the flange and a stem of the pin extends from the head upwardly through a bore in the body, the tail end of the stem being upset to secure the assembly by clamping the body against the head of the pin. The body is formed externally with a screw thread which enables the stud to be secured in a complementary threaded socket provided in a shoe sole. By unscrewing the stud it can be replaced should it become damaged or unduly worn.

That stud construction has been very successful in particular for golf shoes, but increasingly there is a demand for such studs to be more resistant to wear.

To militate against wear of the nose of a stud, it is known to introduce a hard insert into the nose. For example, as described in GB-A-1 277 684, U.S. Pat. No. 3,766,670 and WO 92/02156 a ball of a hard wear-resistant material such as tungsten carbide may be secured at the tip of the stud nose, it being the tip that in practice usually suffers the greatest wear. An alternative method of achieving a similar result is described in U.S. Pat. No. 3,600,831 and U.S. Pat. No. 3,552,043, a cylindrical stump of hard material there being housed within a tubular end portion of a steel pin which otherwise forms the stud nose.

Both of these methods of increasing the wear-resistance of the stud nose can be partially satisfactory but undue wearing of the remainder of the nose may still occur and ultimately the hard tip insert can come loose and be lost.

Addressing both of these problems, proposals have been made for the entire nose (by which is meant at least all of the visible part of the nose, presenting the ground-engaging surfaces) to be of wear-resistant material. As described in GB-A-2 248 762, a non-replaceable stud (nose and body) may be formed of ceramic material in one piece, for permanent incorporation into a shoe sole with the nose projecting from the sole surface. Alternatively, and enabling a screw-threaded stud body to be provided to allow for replacement of the stud, there is described a proposal for a short nose of ceramic material to be secured to a steel base; the base forms both a sole-engaging flange and a threaded spigot. In the arrangement described, the nose is located in a shallow recess in the base and secured in the recess by means of an adhesive.

It is an object of the present invention to provide improvements in the construction of hard-wearing shoe studs.

The invention provides, in one of its aspects, a stud for an article of footwear comprising stud-mounting means for enabling the stud to be secured in the underside of the article and from which a ground-engaging nose of a hard wear-resistant material projects, the stud-mounting means comprising a moulded plastics body of which undersurfaces are shielded from engagement with the ground by a wear-resistant lamina secured to overlie those surfaces.

Portions of the wear-resistant lamina, which may be of steel or other suitable metal, may be interposed between the nose and the body, and the lamina may be an otherwise loose element which is held secured against the body by the nose.

In a replaceable form of stud in which the stud-mounting body comprises an externally threaded spigot and a broad flange which is arranged to engage undersurfaces of the article when the spigot is secured in a socket in the article, the lamina overlies undersurfaces of the moulded flange. In such a case it is ordinarily desirable that the lamina be interlocked with the flange to enable torque to be transmitted from the lamina to the body in inserting or removing the stud into or from the socket. In a preferred construction, a polygonal (e.g. square) aperture in the centre of the lamina fits over a correspondingly-shaped boss on the underside of the body, but to ensure such interlocking the lamina interacts with the moulded flange at keying formations which enable a suitable torque-transmitting tool to be applied.

It is to be understood that orientational terms are used herein in relation to the stud in its normal orientation for use, in which the nose of the stud would project downwardly from the underside of the shoe.

The hard, wear-resistant, material of which the nose is formed may be tungsten carbide or other suitable material of exceptionally hard-wearing character.

In another of its aspects the invention provides a stud for an article of footwear comprising stud-mounting means enabling the stud to be secured in the underside of the article and from which a ground-engaging nose of a hard wear-resistant material projects, the stud-mounting means comprising a moulded plastics body and the nose being secured to the body by means of a metal stump which projects from the body, the nose being recessed to fit over the stump.

The nose may be bonded to the stump to ensure retention. For example in the case of a tungsten carbide nose on a steel stump, bonding may be by brazing.

The stump may comprise a portion of tapering (e.g. frusto-conical) form which is engaged in a similarly tapering portion of the recess in the nose; there may be a small difference in taper angle between the two, for example to ensure efficiency in producing a brazed joint. In such a tapering arrangement, it may be desirable for there to be an entry portion of the recess in the nose which is of parallel-sided (e.g. cylindrical) form to receive a portion of the stump of corresponding parallel-sided form, to ensure accurate co-axial alignment of the nose on the stump.

The metal stump may be formed by an end portion of a stem which extends through the plastics body. The stem may extend right through the body and an upper end portion may be out-turned for securement of the body against the nose.

There now follows a description, to be read with reference to the accompanying drawings, of two golf shoe studs which illustrate the invention by way of example.

Figure 1:
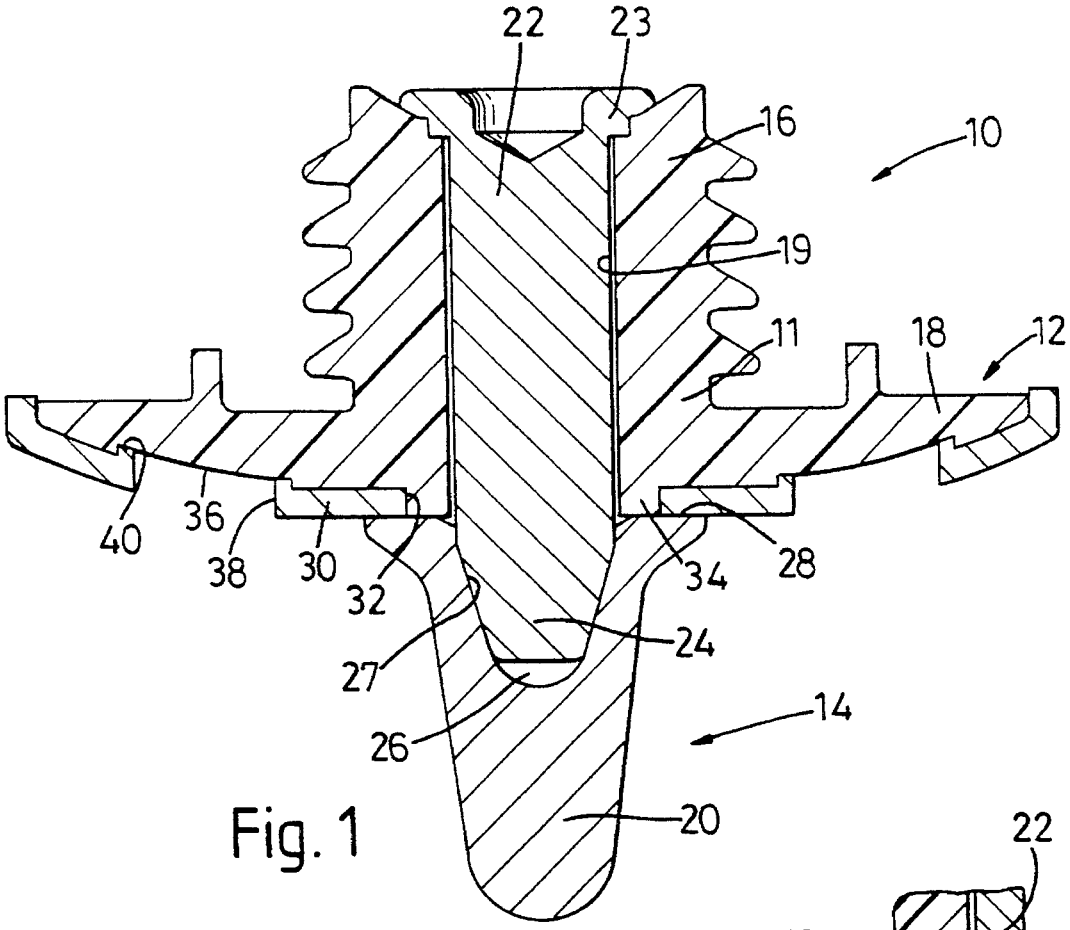
FIG. 1 is a longitudinal cross-section through a replaceable stud.
Figure 2:
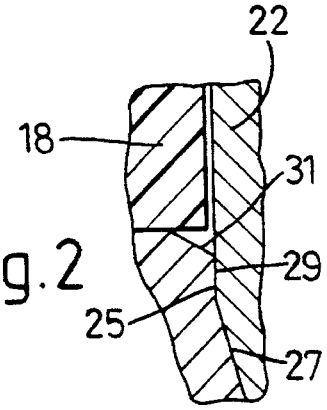
FIG. 2 shows features of the stud of FIG. 1 to a larger scale.

FIGS. 1 and 2 show a golf shoe stud which comprises an externally screw-threaded upper portion 10 enabling it to be secured in a complementary threaded socket within a golf shoe sole. It comprises also a disc-like intermediate portion 12 forming a broad encircling flange for engagement with an outer surface of the sole around the socket. Finally, it comprises a lower portion 14 comprising a ground-engaging nose projecting downwards from the intermediate portion. The upper and intermediate portions together form mounting means of the stud, enabling the stud to be located and secured firmly in the underside of the shoe.

A unitary plastics moulding 11 forms both an externally screw-threaded spigot 16 of the upper portion 10 and a relatively large diameter disc-like portion forming a flange body 18 of the intermediate portion 12. A pin member extends all the way through a central bore 19 of the moulding 11 and comprises an enlarged head 20 at its lower end; upper surfaces of the head abut the underside of the intermediate portion. A steel stem 22 of the pin, which extends upwards from the head 20 through the bore 19 in the moulding, has a hollowed upper end portion 23 rolled outwards to secure the moulding 11 between the out-turned portion 23 and the pin head 20 in the manner of a rivet.

The head 20 of the pin comprises a shaped nose-forming body of tungsten carbide which forms all external surfaces of the nose. The carbide body fits as a cap over a stump 24 formed by a lower end portion of the steel stem 22 which projects from the bore 19 below the flange body 18. The carbide body is formed with a suitable recess 26 to accommodate the stump 24, and a flat upwardly-facing annular end surface 28 of the carbide body, around the entry to the recess 26, abuts opposing flat undersurfaces of the intermediate portion 12 of the stud. The body is secured to the stump by brazing.

As shown to a larger scale in FIG. 2, the lower end portion of the stem, projecting from the bore 19, is of frusto-conical tapering form except for a short continuation 25 of a cylindrical form which the stem has throughout its length extending through the bore 19 to the out-turned upper end portion 23. The recess 26 in the carbide body provides corresponding frusto-conical 27 and cylindrical 29 surfaces for location of the body on the stump, though the angles of taper (as between that of the stump and that of the carbide body) are slightly different to ensure that full wetting of the joint occurs during brazing. There is a chamfer 31 on the carbide body around the entry to its recess 26 which can accommodate any small excess of brazing material from the joint.

The tungsten carbide body provides a nose of hard, wear-resistant, material for ground engagement. The steel stem, the stump of which projects deeply into the body (approximately 36% of the body's depth), provides a very secure location for the carbide body and substantial shear strength for the projecting lower end portion 14 of the stud as a whole.

The intermediate portion 12 comprises also a thin metal covering element forming a lamina 30 as a shield to overlie and protect the underside and edges of the plastics moulding 11. The lamina, which is of a suitable steel, is formed with a central square aperture 32 which is located on a central square boss 34 of the moulding 11; the axial boss length is similar to, but not greater than, the thickness of the lamina. Portions of the lamina interposed between the nose and the moulding become clamped to the underside of the moulding by the end surface 28 of the nose in assembly of the stud.

There are four circular recesses 36 moulded into the underside of the flange body 18, uniformly disposed about the stud axis, and four apertures 38 are correspondingly formed in the lamina 30 to oppose them. Around each aperture 38 the shield is formed with a shallow upturned lip 40 which is located in the associated recess 36. The engagement of the lips 40 in the recesses 36, and the location of the lamina on the square boss 34, together ensure that the lamina is interlocked with the moulding 11 against relative rotation. The four recesses 36 and corresponding apertures 38 provide keying formations enabling engagement by corresponding formations on a suitable tool for the transmission of torque to the stud for insertion and removal of the stud.

The ground-engaging surfaces of the stud being provided wholly by the tungsten carbide nose 20 and the metal lamina 30, the stud is of significantly improved wear resistance. The attachment for the nose being substantially wholly within the nose, and so fully protected, there is no related danger of the securement of the nose being undermined by wear. Similarly, the provision of the metal lamina over the plastics flange body 18 ensures that the integrity of the keying formations is preserved.

Figure 3:
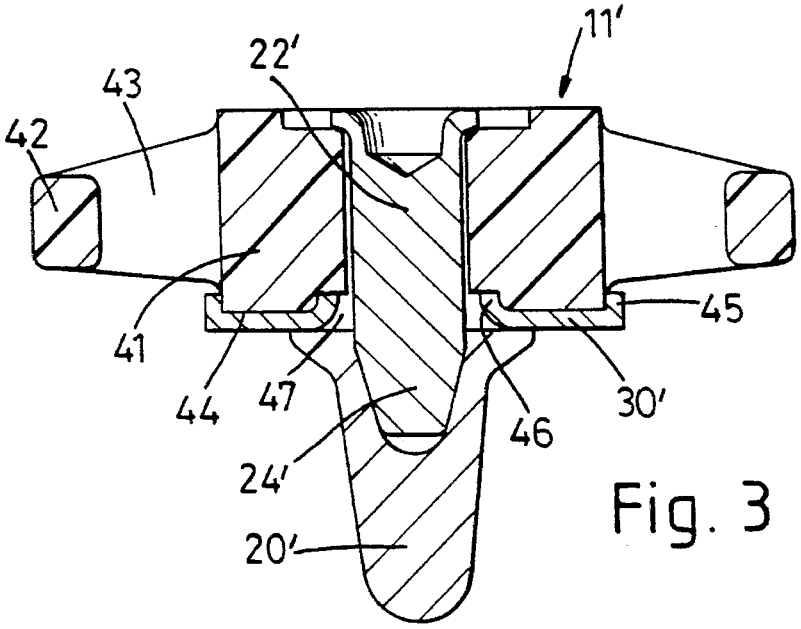
FIG. 3 is a view similar to FIG. 1 but of a non-replaceable stud.

A very similar construction of stud, including provision of a tungsten carbide nose 20' and a metal lamina 30' over a moulded plastics stud-mounting body 11', is exhibited by a non-replaceable stud shown in FIG. 3. In this stud the pin member, comprising the nose 20', brazed to a stump 24' of a steel stem 22' is substantially identical to that of the replaceable stud hereinbefore described and illustrated in FIGS. 1 and 2. The moulded body 11', however, is of a known form suitable for incorporation during the moulding of a moulded sole or heel portion of a shoe; the circular body 11' comprises a central portion forming a hub 41, though which the pin stem 22' extends, and a peripheral portion forming a ring 42 which is joined to the hub at spaced circumferential intervals by means of radially-extending blocks 43.

The metal lamina 30', which is of a suitable steel, is of circular disc form to cover an annular undersurface 44 of the plastics hub 31. An outer peripheral portion of the lamina is upturned as a flange 45 to embrace the hub moulding. In use of the stud, forces can arise which give a tendency to bursting of the moulded body 11'. The embracing flange 45 of the lamina provides added strength to resist any such tendency.

The lamina has a circular central aperture, through which the pin stem 22' extends, and an inner peripheral portion of the lamina is also upturned as a flange 46 which fits a short cylindrical central rebate 47 in the underside of the hub 41. The diameter of the rebate 47, and the internal diameter of the inner flange 46 of the lamina, are both greater than the outer diameter of the chamfered entry on the nose 20' around the stem 22'. This can ensure that any overspill of brazing material from the chamfered entry will not interfere with seating of the flat annular upper surface of the nose against an opposing flat undersurface of the lamina 30'. As in the case of the first stud described, the nose of the pin member holds the lamina in place on the moulded body 11'.

We claim:

1. A stud for an article of footwear comprising stud-mounting means enabling the stud to be secured in the underside of the article, a ground-engaging nose which projects from said stud-mounting means, and a wear-resistant lamina which is held secured to overlie undersurfaces of said stud-mounting means and shield them from engagement with the ground, said stud-mounting means comprising a first portion forming an externally screw-threaded spigot and a molded plastics second portion forming a broad flange which extends about said spigot and is arranged to engage undersurfaces of the article when said spigot is secured in the underside of the article, and said wear-resistant lamina overlying undersurfaces of said plastics flange to shield them from the ground and being interlocked with said stud-mounting means to enable torque to be transmitted from said lamina to said stud-mounting means in securing the stud in an article of footwear, the ground-engaging nose being of a hard wear-resistant material and being secured to said stud-mounting means by means of a metal stump which projects from the stud-mounting means, the nose being recessed to fit over the stump.

2. A stud according to claim 1 in which a metal stem extends through the plastics flange, an end portion of the stem comprising the stump (24).

3. A stud according to claim 2 in which the stem (22) extends right through the stud-mounting means (11) and an upper end portion (23) is out-turned for securement of the stud-mounting means (11) between the out-turned portion (23) and the nose (20).

4. A stud according to claim 1 in which the stump (24) comprises a portion of tapering form which is engaged in a similarly tapering portion (27) of the recess (26) in the nose (20).

5. A stud according to claim 4 in which an entry portion (29) of the recess (26) in the nose (20) is of parallel-sided form to receive a portion (22) of the stump (24) of corresponding parallel-sided form, to ensure accurate co-axial alignment of the nose on the stump.

6. A stud according to claim 1 in which said first portion of paid stud-mounting means forming an externally screw-threaded spigot is of molded plastics and formed integrally with said molded plastics second portion forming a broad flange.

7. A stud for an article of footwear comprising stud-mounting means enabling the stud to be secured in the underside of the article, a ground-engaging nose which projects from said stud-mounting means, and a wear-resistant lamina which is held secured to overlie undersurfaces of said stud-mounting means and shield them from engagement with the ground, said stud-mounting means comprising a first portion forming an externally screw-threaded spigot and a molded plastics second portion forming a broad flange which extends about said spigot and is arranged to engage undersurfaces of the article when said spigot is secured in the underside of the article, and said wear-resistant lamina overlying undersurfaces of said plastics flange to shield them from the ground and being interlocked with said stud-mounting means to enable torque to be transmitted from said lamina to said stud-mounting means in securing the stud in an article of footwear, said wear-resistant lamina being rotationally interlocked with the plastics flange to enable torque to be transmitted from the lamina to the plastics flange in inserting and removing the stud, said wear-resistant lamina having keying formations enabling a suitable torque-transmitting tool to be applied to the stud.

8. A stud according to claim 7 in which portions of the wear-resistant lamina (30) are interposed between the nose (20) and the stud-mounting means (11).

9. A stud according to claim 8 in which the lamina (30) is held secured against the stud-mounting means (11) by the nose (20).

10. A stud according to claim 7 in which the lamina (30) is of metal.

11. A stud according to claim 7 in which said keying formations include portions projecting toward and engaging said plastics flange for rotationally interlocking said wear-resistant lamina and said plastics flange.

12. A stud according to claim 7 in which said plastics flange is provided with a plurality of downwardly opening recesses, and said keying formations include openings in said wear-resistant lamina aligned with said recesses.

13. A stud according to claim 12 in which the openings in said wear-resistant lamina are surrounded by integral, upwardly projecting lips, said lips projecting into and interlockingly engaging with said recesses.

14. A stud according to claim 7 in which said first portion of said stud-mounting means forming an externally screw-threaded spigot is of molded plastics and formed integrally with said molded plastics second portion forming a broad flange.

* * * * *